United States Patent [19]

Guess

[11] 4,084,517

[45] Apr. 18, 1978

[54] COLLAPSABLE TABLE

[76] Inventor: Westphal Claude Guess, 2121 Leadville, Boise, Id. 83706

[21] Appl. No.: 806,003

[22] Filed: Jun. 13, 1977

[51] Int. Cl.[2] ..... A47B 3/06

[52] U.S. Cl. ..... 108/153; 297/442

[58] Field of Search ..... 108/153, 154, 155, 157; 297/442, 157, 159; 248/165

[56] References Cited

U.S. PATENT DOCUMENTS

| | | | |
|---|---|---|---|
| 401,798 | 4/1889 | Spencer | 297/442 X |
| 1,940,117 | 12/1933 | Carpos | 108/157 |
| 3,338,189 | 8/1967 | Xavier | 108/159 |
| 3,572,824 | 3/1971 | Schupbach | 297/442 X |
| 3,758,152 | 9/1973 | Lake | 108/153 X |

FOREIGN PATENT DOCUMENTS

| | | | |
|---|---|---|---|
| 185,565 | 9/1922 | United Kingdom | 108/157 |

*Primary Examiner*—James T. McCall
*Attorney, Agent, or Firm*—Paul F. Horton

[57] ABSTRACT

A collapsable portable table including a table top and a pair of interlocking legs. The table top, on its undersurface, contains a leg receiving block which interlockingly engages the legs. The legs each have an opening substantially in the center thereof which encase the receiving block when the legs are stored flush against the undersurface of the table top for carrying or for storage. Locking means are also provided for retaining the legs either in the standing or in the collapsed position.

9 Claims, 7 Drawing Figures

COLLAPSABLE TABLE

BACKGROUND OF THE INVENTION

1. Field of the Invention

This invention relates, in general, to collapsable tables, and in particular, to collapsable tables which are stored and carried as a unit.

2. Description of the Prior Art

The desirability of collapsable tables has long been recognized. Knock down tables are easily fabricated and may be conveniently interlocked together to provide a solid table without the use of nails, screws, bolts, glue and the like.

In addition, knock down tables when disassembled for storage take up much less room than conventional tables and may be conveniently packaged for shipping, thus greatly reducing freight costs. Additional advantages include a substantial savings in labor for assembling, ease of construction, and portability.

Generally, knock down tables have not met with success for one or more reasons. Many of the tables are so complex that they do not lend themselves to quick fabrication; were not satisfactory since they lacked strength and rigidity required for their intended use; required special tools for assembling; and were easily collapsed unintentionally.

Furthermore, the separate parts of the table were often mislaid, lost, or broken because of a lack of a storage container or because of the temporary nature of the storage container. Because of the complexity of some of the tables, the cost of manufacture was greatly increased, making the tables too expensive.

Early collapsable tables and supports included that of Lauer, U.S. Pat. No. 1,261,138 and Fackler, U.S. Pat. No. 2,107,178. More recent disclosures, include those of Curtis U.S. Pat. No. 2,615,770 and 2,615,771 and Kovener, U.S. Pat. No. 3,510,027.

SUMMARY OF THE INVENTION

The present invention comprises, generally, a collapsable and portable table having a table top with a substantially planar upper and lower surface, a leg receiving block securely attached to the undersurface of the table top substantially in the center thereof and a pair of table legs which interlock with each other as well as the leg receiving block. Each leg contains a central opening, which, when the legs are placed together flush upon the bottom surface of the table top, encase the leg receiving block. The leg receiving block may also contain locking means to prevent collapse of the table when in the standing position, and to prevent accidental removal of the legs when in the stored position.

It is therefore, generally, an object of the present invention to provide a collapsable table which is inexpensive to manufacture, which is easy to assemble, and which has good strength and rigidity.

It is, more particularly, an object of the present invention to provide a knock down table in which the legs are conveniently stored within the casing on the undersurface of the table top.

Even more particularly, it is an object of the present invention to provide a knock down table having a table top which contains on its lower surface a leg receiving block which is operable to engage the top of the legs while in the standing position and which is operable to engage the center of the legs when in the stored position to hold the legs firmly in place.

It is also an object of the present invention to provide a collapsable knock down table having locking means to lock the legs of the table to the table top in both the standing and stored positions.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
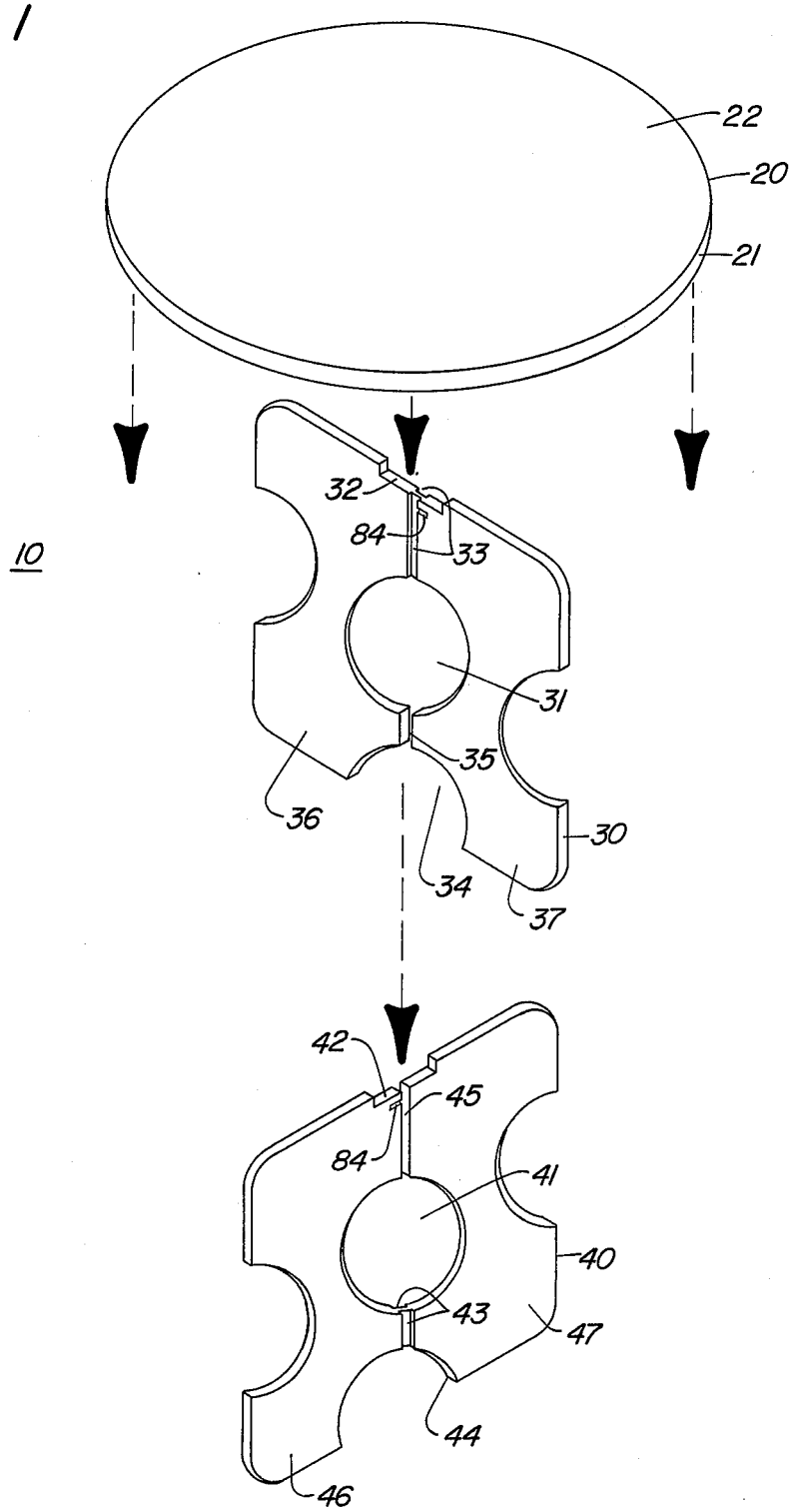
FIG. 1 is a perspective view showing one embodiment of the present invention as it is assembled to the standing position.
Figure 2:
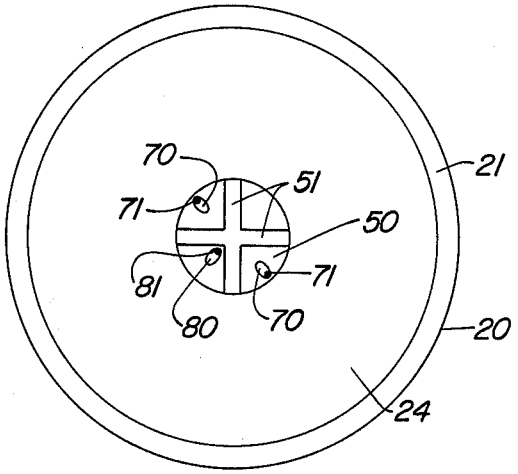
FIG. 2 is a plan view of the undersurface of the table top of FIG. 1 showing the leg receiving block.

Referring now to the drawings, and more particularly, to FIGS. 1 and 2, one embodiment of a collapsable table 10, made according to the present invention is disclosed. Table 10 includes a table top 20, a pair of interlocking legs 30 and 40, and a leg receiving block 50, see FIG. 2.

Table top 20 includes substantially planar top surface 22 and bottom surface 24. In the preferred embodiment, table top 20 includes a downwardly depending flange 21 about the perimeter of the table top. The depth of the flange below the undersurface of the table top is preferably equal to the combined thicknesses of the essentially flat legs 30 and 40 for storing purposes, as will hereinafter be explained. The table may be made of any of the common materials such as wood, plastics, or metals. It is also contemplated that the top surface 22 of table top 20 may be venerred, as in standard table tops.

Figure 3:
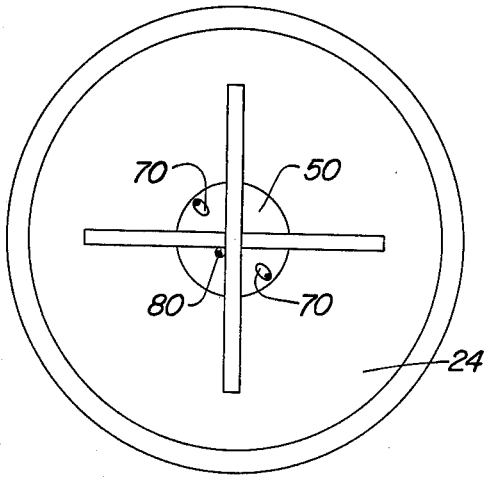
FIG. 3 is a plan view of the undersurface of the table top of FIG. 1, shown assembled.
Figure 4:
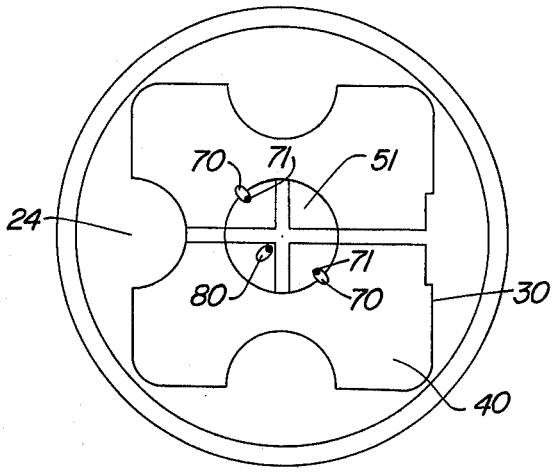
FIG. 4 is a plan view of the undersurface of the table top of FIG. 1 showing the legs in a stored position.

Referring now to FIGS. 2, 3, and 4, the leg receiving block of one preferred embodiment of the present invention may be seen to advantage. Leg receiving block 50 may be round in configuration, in which case the diameter of block 50 must be slightly smaller than the central openings 31 and 41 of legs 30 and 40, respectively, as shown in FIG. 1. It is an essential element of the present invention that the receiving block 50 be of lesser width than the openings in the legs for proper storage of the legs on the undersurface of the table top. Block 50 includes two notches 51 which extend the complete diameter of the block and intersect one another at substantially right angles. Depth of the notches should be sufficient to prevent any rotation or lateral movement of the legs in respect to the block. Block 50 may be mounted to the undersurface 24 of table top 20 in the center of the undersurface by means of glue, screws, or other conventional fastening means. Leg receiving block 50 may be made of any suitable material.

As may be seen in FIGS. 1 and 3 legs 30 and 40 of collapsable table 10 are essentially plate like, having vertical coplanar opposing surfaces. Each of the legs 30 and 40, contain at their uppermost edge a pair of horizontally extending, rectilinear, table top contacting surfaces separated by a recede portion 32 and 42, respectively. The recede portions are flat and extend horizontally parallel with the table top contacting surfaces. Leg 30 includes a pair of oppositely disposed grooves 33 extending vertically from the center of recede portion 32 to an opening 31 located in the center of the leg. Leg 30 also contains a vertical slit 35, in alignment with grooves 33, extending from opening 31 to a second recede portion 34 which defines two floor contacting shoes 36 and 37. Leg 40 has the same general configuration and the same dimensions as leg 30. Leg 40 includes a vertical slit 45 extending from first recede portion 42 to a centrally located opening 41, and a pair of oppositely disposed grooves 43 extending from opening 41 to a second recede portion 44 which defines a pair of floor contacting shoes 46 and 47.

In assembling collapsable table 10, leg 30 is lowered onto leg 40 so that the edges of the leg which define slit 35 interlockingly engage the grooves 43 of leg 40. In the process, the edges of leg 40 defining slit 45 interlockingly engage grooves 33 of leg 30. It will therefore be seen that legs 30 and 40 are locked together at right angles one to the other in an immovable relationship. Table top 20 is then lowered onto the uppermost surfaces of legs 30 and 40 so that the horizontally extending, rectilinear, top surfaces of recede portion 32 and 42 mate with and interlockingly engage notches 51 of leg receiving block 50. The rectilinear top edges of the legs protruding above the recede portions concurrently make flush contact with bottom surface 24 of table top 20. The process is simply reversed for dismanteling.

For storage, or for carrying, legs 30 and 40 are placed flat against one another with the planar side surfaces of the legs laying flush against one another and against the bottom surface 24 of table top 20 as may be seen to advantage in FIG. 4. The centrally located circular openings 31 and 41 of legs 30 and 40 respectively, encase leg receiving block 51 in a snug relationship. The uppermost surface of the outermost leg is flush with the top surface of leg receiving block 51 and depending flange 21 of table top 20 while in this stored position.

Figure 5:
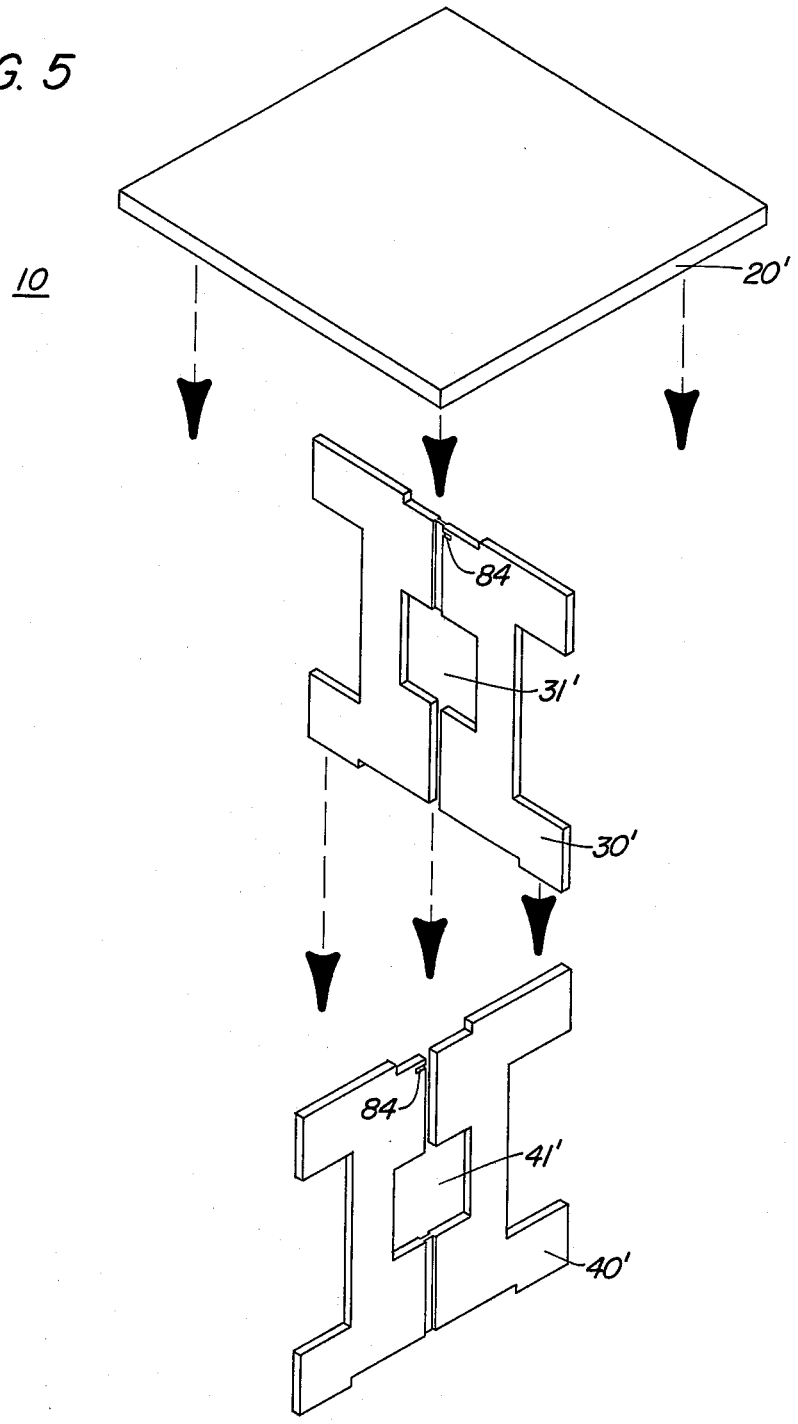
FIG. 5 is a perspective view of a second embodiment of the present invention shown in position to be assembled.
Figure 6:
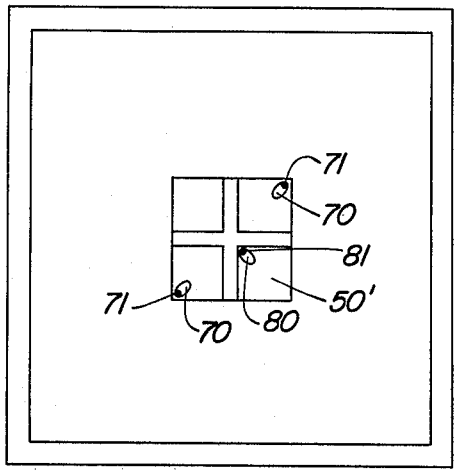
FIG. 6 is a plan view of the undersurface of the table top of FIG. 5 showing the leg receiving block.
Figure 7:
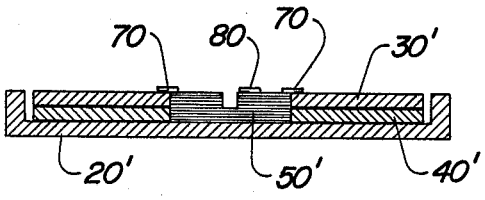
FIG. 7 is a cross sectional view of the table top of FIG. 5 showing the legs in a stored position.

Referring now to FIG. 5 and 6, a second preferred embodiment of the present invention may be seen. The second embodiment differs from the above described embodiment primarily in the square shapes of top and legs and in the configuration of leg receiving block 50' and central openings 31' and 41' of legs 30' and 40', respectively. In the second embodiment the central leg openings and the leg receiving block are both square, the openings being slightly larger than the block for convenient storage as previously mentioned. The square configuration of the block and openings, while lacking the advantage found in the circular block and openings as previously described of storage of the legs at any angle relative to the block, does have the particular advantage of holding the legs in a secure and non rotatable position relative to the block and to the undersurface of the table top.

In either embodiment, the table may include a first locking means, locking flanges 70 located on the bottom surface of receiving blocks 50 or 50' as may be seen in FIGS. 4 and 6. Flanges 70 are horizontally rotatable about pins 71, and in operation are rotated so that the undersurface of the flange comes in contact with the uppersurface of the side of a leg to hold the legs flush against the undersurface of the table top for storage and for carrying. The table may also contain a second locking means to lock the legs to the undersurface of the table top and leg receiving block to maintain the table in an assembled position. For this purpose, a flange 80 is mounted on the bottom surface of the receiving block adjacent the intersecting notches 51 as may be seen in FIGS. 2 and 6. Flange 80 is rotated to engage flange receiving slots 84 which are located adjacent to and parallel with the top surface of the first recede portion of the legs and transverse to the vertical grooves and slits of the legs as may best be seen in FIGS. 1 and 5.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A collapsable table comprising:

a table top having substantially planar upper and lower horizontal surfaces;

a leg receiving block securely attached to the undersurface of said table top, said block including a pair of rectilinear, horizontally extending, intersecting notches adapted to interlockingly engage a pair of table legs;

a pair of table legs; each leg having a thickness equal to one-half the thickness of said block; each leg having vertical coplanar opposing surfaces; each of said legs including an uppermost terminal edge defining a pair of horizontally extending, rectilinear, table top contacting surfaces separated by a first recede portion having a horizontally extending, rectilinear, top surface, the first recede portion being operable to engage a notch in said leg receiving block; each of said legs including a pair of floor contacting surfaces separated by a central second recede portion; each of said legs including a centrally located opening adapted to encase said leg receiving block when in the stored position; one of said legs including a vertical slit communicating between the opening and the first recede portion and a vertical groove aligned with the slit communicating between the opening and the second recede portion; and the other of said legs including a vertical groove communicating between the opening and the first recede portion and a vertical slit aligned with the groove communicating between the opening and the second recede portion; the grooves of one leg adapted to interlockingly engage the slit of the other leg whereby said legs may be juxtaposed over one another at right angles one to the other.

2. A collapsable table as described in claim 1, further comprising a locking means for locking said table legs to said table top, in an upstanding position.

3. A collapsable table as described in claim 2, wherein said locking means includes a horizontally rotatable locking flange located on the bottom surface of said leg receiving block adjacent the intersection of the notches, and a flange receiving slot located in each leg adjacent to and parallel with the top surface of the first recede portion.

4. A collapsable table as defined in claim 1, further comprising:

a pair of horizontally rotatable locking flanges, diametrically opposed on the bottom surface of said leg receiving block, said locking flanges operable to engage a planar surface on said legs to secure said legs to the undersurface of said table top in a stored position.

5. A collapsable table as defined in claim 1, wherein said leg receiving block is substantially square in configuration and wherein the notches of said block intersect at right angles.

6. A collapsable table top as defined in claim 1, wherein said leg receiving block is substantially circular in configuration and wherein the notches of said block intersect at right angles.

7. A collapsable table as defined in claim 1, wherein the diameter of said legs does not exceed the diameter of said table top.

8. A collapsable table as defined in claim 1, wherein said table top includes a flange depending about the perimeter said flange depending a distance greater than or equal to the thickness of sum of the two legs so that the end portions of said legs are substantially encased by said flange, when the legs are in a stored position.

9. A collapsable table comprising:

a table top having substantially planar upper and lower horizontal surfaces, and a depending flange about the perimeter of said table top;

a leg receiving block securely attached to the undersurface of said table top substantially in the center thereof, said block including a pair of intersecting notches adapted to interlockingly engage a pair of table legs;

a pair of table legs, each leg having a thickness equal substantially to one-half the thickness of said block and said depending flange, each leg having vertical coplanar opposing surfaces; each of said legs including an uppermost terminal edge defining a pair of rectilinear, horizontally extending table top contacting surfaces separated by a first recede portion having a rectilinear, horizontally extending, top surface, the first recede portion being operable to engage a notch in said leg receiving block; each of said legs including a pair of floor contacting surfaces separated by a central second recede portion; each of said legs including a centrally located opening adapted to encase said block when in the stored position; one of said legs including a vertical slit communicating between the opening and the first recede portion and a vertical groove aligned with the slit communicating between the opening and the second recede portion, and the other of said legs including a vertical groove communicating between the opening and the first recede portion and a vertical slit aligned with the groove communicating between the opening and the second recede portion; the grooves of one leg adapted to interlockingly engage the slits of the other leg whereby said legs may be juxtaposed over one another at right angles one to the other;

first locking means to lock said legs to the undersurface of said table top in a stored position; and second locking means for locking said table legs to said table top in an upstanding position.

* * * * *